US005941747A

United States Patent [19]

Garofalo

[11] Patent Number: 5,941,747

[45] Date of Patent: Aug. 24, 1999

[54] OPEN-SHOE TYPE SWIMMING FLIPPER

[75] Inventor: Giovanni Garofalo, Rapallo, Italy

[73] Assignee: HTM Sports S.p.A., Genova, Italy

[21] Appl. No.: 09/044,269

[22] Filed: Mar. 19, 1998

[30] Foreign Application Priority Data

Apr. 18, 1997 [IT] Italy ..... GE97A0036

[51] Int. Cl.[6] ..... A63B 31/11

[52] U.S. Cl. ..... 441/64

[58] Field of Search ..... 441/61–64; D21/239

[56] References Cited

U.S. PATENT DOCUMENTS 2,903,719 9/1959 Wozencraft .

FOREIGN PATENT DOCUMENTS 0 572 853 5/1993 European Pat. Off. .

0 685 242 5/1995 European Pat. Off. .

2237747 5/1991 United Kingdom ..... 441/64

*Primary Examiner*—Ed Swinehart

*Attorney, Agent, or Firm*—King and Schickli

[57] ABSTRACT

Open-shoe type swimming flipper, to be worn on a foot wearing a boot, the shoe including an element of insole and an element for holding the front of the boot. The element of insole of the flipper is provided with a number of coupling elements which fit into a number of complementary coupling elements made in the sole of said boot. The element for holding the front of the foot is connected permanently at least along one side edge to one side edge of the part of the insole of the flipper, whilst the other side edge may be connected by clasping devices directly to the opposite side edge of the part of insole of the flipper or to the free edge of an element, which, in turn is connected to said opposite side edge of the part of insole of the flipper.

9 Claims, 4 Drawing Sheets

OPEN-SHOE TYPE SWIMMING FLIPPER

BACKGROUND OF THE INVENTION

The subject of the present invention is a swimming flipper of the open-shoe type, to be worn by a scuba diver wearing appropriate boots.

In the U.S. Pat. No. 5,588,890 by the same inventor, a flipper is described of the same type as the one mentioned above, in which the insole of the portion of shoe presents two or more longitudinal ribs, and in which the boot to be worn together with said flipper presents a corresponding set of grooves complementary to said ribs.

Owing to the said coupling together of ribs and grooves between the shoe and the boot, such a flipper affords better stability when it is worn. However, in the aforesaid flipper it is necessary in every case for the shoe to be provided with a heel strap in view of the fact that both the boot and the flipper may easily slip off during swimming, since this type of coupling prevents any movement in the transverse direction but not that in the longitudinal direction between the flipper and the foot of the user.

SUMMARY OF THE INVENTION

The main purpose of the present invention is thus that of creating a swimming flipper of the shoe type open at the back, to be worn on a foot wearing a special boot, where between the insole of the flipper and the boot there are devices of firm constraint both in the longitudinal direction and in the transverse direction, such as to prevent undesirable relative movements between the boot and the flipper, with the possibility of eliminating the need for a rear heel strap.

A further purpose of the present invention is a flipper of the type described above, where the shoe-like part is made so that it can be opened, at least partially, so as to enable easy insertion of the foot provided with boot into the shoe, in order to enable the said complementary devices of constraint between the insole of the shoe and the sole of the boot to slot together, there being provided on the shoe clasping devices for fastening said part of shoe over the boot so as to secure these parts firmly together.

BRIEF DESCRIPTION OF THE DRAWINGS

These and other characteristics of the present invention will emerge more clearly from the following description of some of its embodiments, in which reference is made to the attached drawings, where.

Finally.

DESCRIPTION OF THE PREFERRED EMBODIMENTS OF THE INVENTION

With reference to the drawings, and with particular reference first of all to FIGS. from 1 to 4, the flipper according to the invention illustrated therein is of the open-shoe type and includes one part of blade 2 which extends at the rear to form the insole 2' of the shoe-like part of the flipper. The insole part 2' presents on the inside a number of slot-in constraining elements, illustrated as recesses 8, the function of which will be described in what follows.

Figure 1:
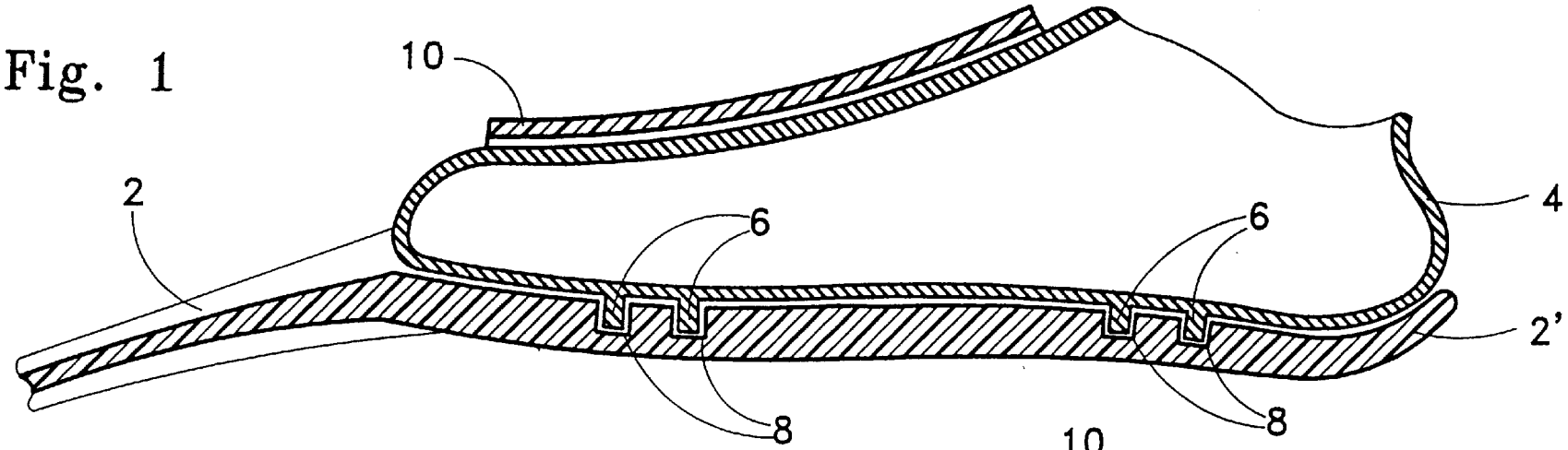
FIG. 1 is a schematic longitudinal section representation of a swimming flipper with corresponding boot according to a first embodiment of the present invention, where the shoe-like part of the flipper is made up of two half-shells which can open out and may be fastened to one another by appropriate clasping devices.
Figure 2:
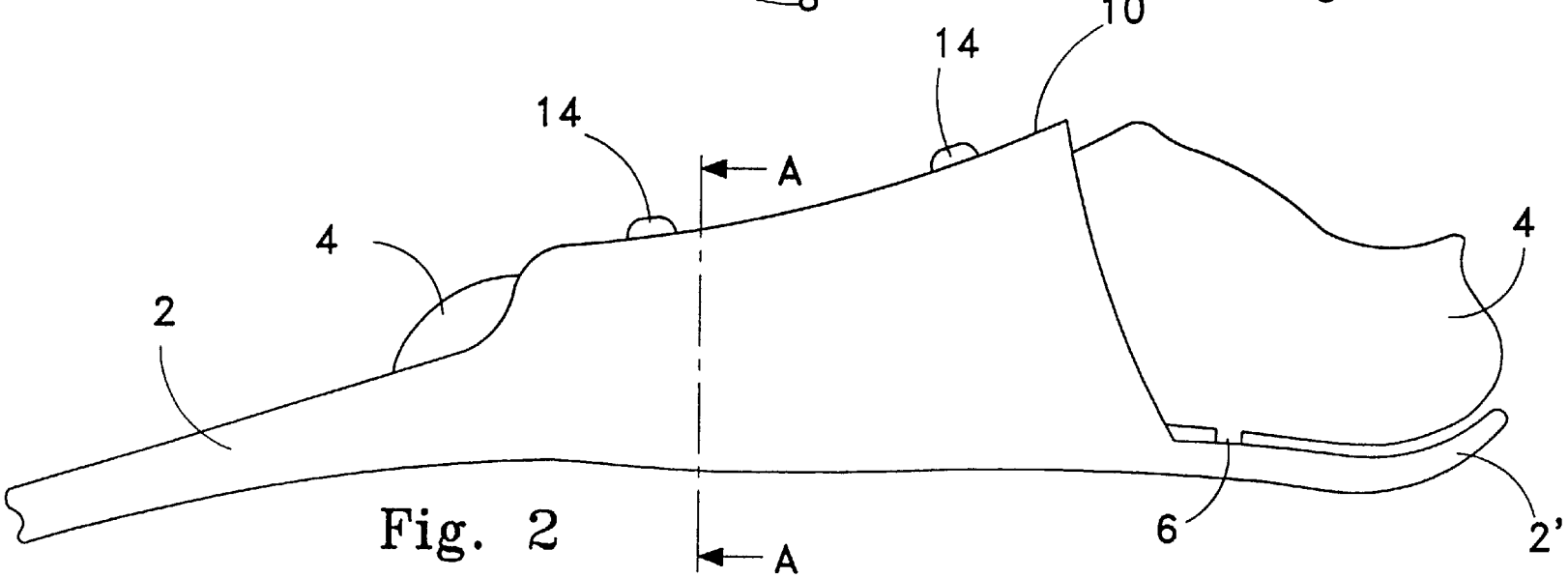
FIG. 2 is a side elevation of the flipper of FIG. 1.
Figure 3:
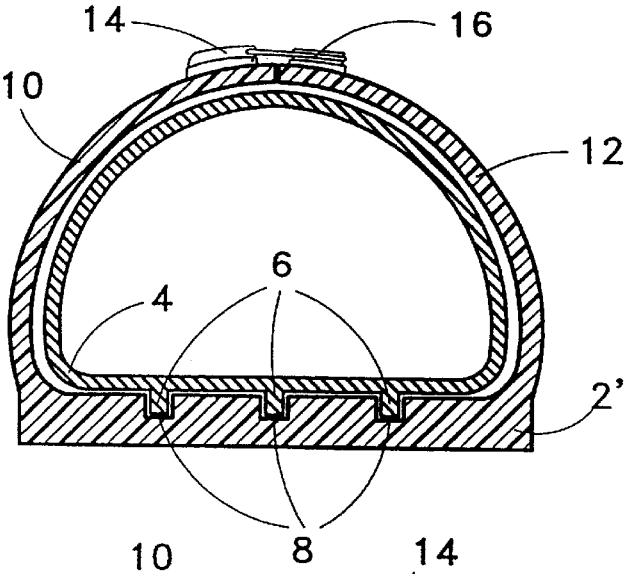
FIG. 3 is a cross-sectional view along the plane indicated by the line A—A of FIG. 2 of the flipper-boot unit of FIGS. 1 and 2 with the two half-shells of the shoe part of the flipper locked in the closed position on the user's foot.
Figure 4:
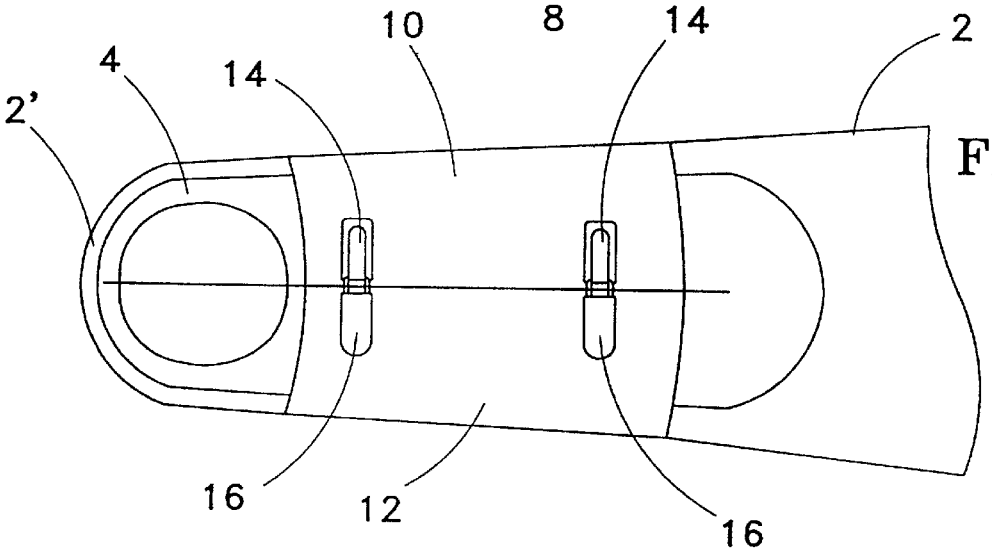
FIG. 4 is a top plan view of the flipper of FIGS. from 1 to 3, with the two half-shells in the closed position.

The shoe-like part of said flipper includes two half-shells 10, 12 (see FIGS. 3 and 4), the side edges of which are hinged to the side edges of the part of insole 2'. At the free edges of the two half-shells 10, 12 there are provided clasping devices 14, 16 to fasten these edges together, as is better illustrated in FIGS. 3 and 4. The flipper is completed by a boot 4 equipped in this part of the sole with constraining elements, illustrated as studs 6 complementary and corresponding to the recesses 8 made in the insole part 2' of the flipper. The flipper described works as follows: after putting on the boots 4, the user releases the clasps for closing 14, 16 and is thus able to open out the two half-shells 10, 12—in this connection, see the position of these parts 10 and 12 illustrated in the embodiment of FIG. 5. In this way, the user can easily introduce his foot wearing the boot 4 into the corresponding flipper, pressing the studs 6 of the boot into the recesses 8 of the flipper insole 2'. At this point the two half-shells 10, 12 are closed back onto the user's foot wearing the boot and fastened in the closed position by means of the clasps 14, 16. In this way, the foot is firmly secured to the flipper 2, 2', forming a single piece with it, so that any relative movement between the foot and the flipper is prevented, with consequent maximum efficiency in flipper action and maximum user comfort. The embodiment described above makes it possible to eliminate the heel strap, which is always present in prior art designs of this type of flipper, and which at times can cause a number of problems during swimming, in that the foot inevitably tends to slide backwards and forwards. In addition, with the flipper of the type described above it is possible to make the shoe-like part 10, 11 of a harder plastic material, without this causing tiredness or pain for the user's foot, in so far as the latter is firmly blocked in the shoe without any possibility of relative movements, and hence of rubbing, cramp, etc.

Figure 5:
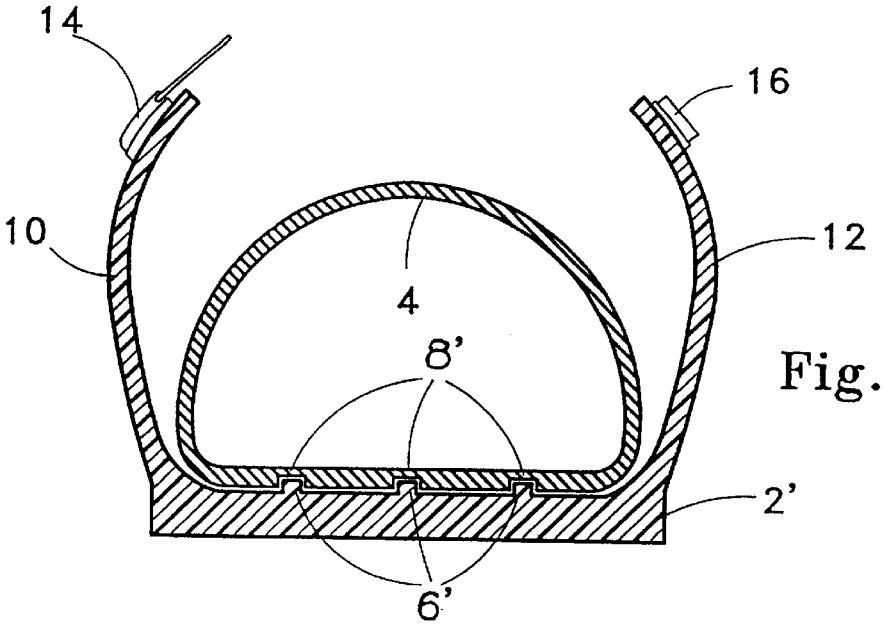
FIG. 5 is a view similar to that of FIG. 3, illustrating a second embodiment of the flipper according to the invention, represented with the two half-shells of the shoe-like part of the flipper opened out to allow the user of the flipper to slide in/out his foot wearing the boot.

FIG. 5 shows a variant of the flipper of FIGS. from 1 to 4, according to which in the part 2' of the flipper insole are made studs 6' which plug into corresponding complementary grooves 8' made in the sole of the boot 4. In this figure, the two half-shells 10, 12 are represented in the opened-out position, i.e., in the position for sliding the foot wearing the boot 4 into/out of the flipper.

Even though the studs 6, 6' respectively, are represented as cylindrical elements which slot into the corresponding cylindrical recesses 8, 8' respectively, it remains understood that these studs, and the recesses corresponding to them, may have any appropriate shape or profile. In the case where, as is illustrated in FIGS. from 1 to 4, these studs are made in the sole of the boot 4, they moreover constitute antislip elements for the scuba diver, in so far as the latter moves wearing the boots without flippers on rocks or on other wet and slippery surfaces.

Figure 6:
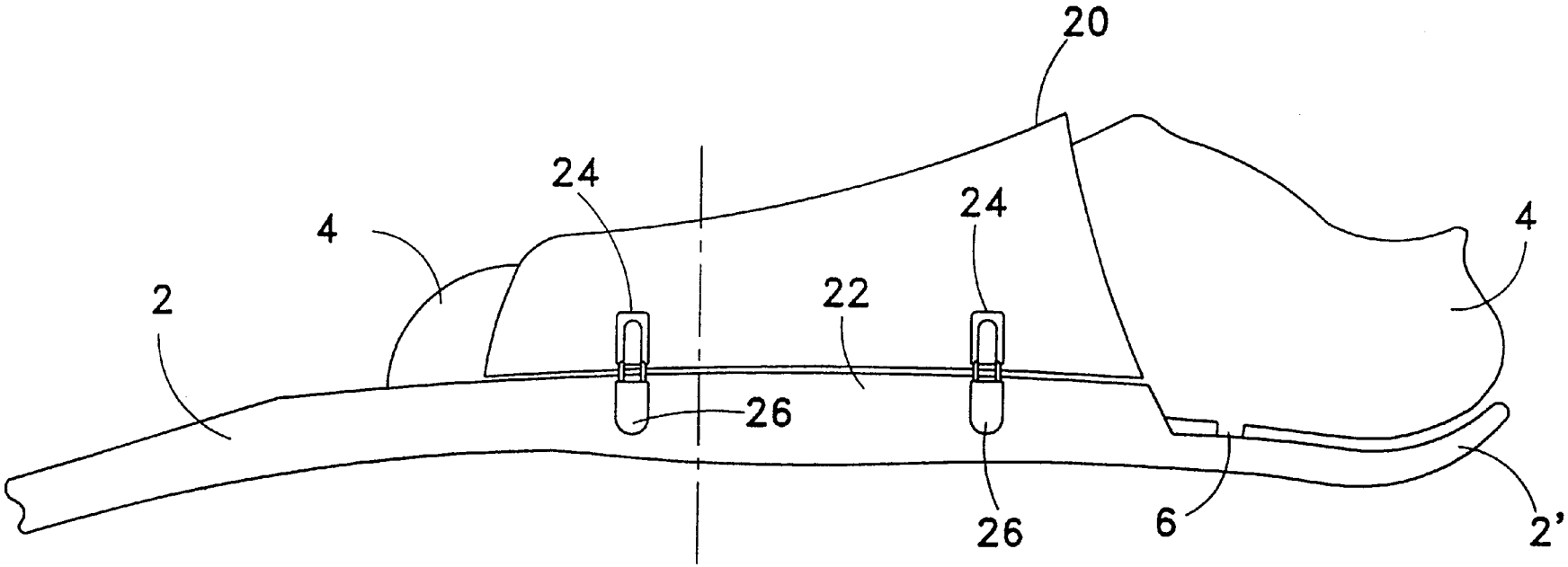
FIG. 6 is an elevation of a third embodiment of the flipper of the invention, according to which the shoe-like part includes only one shell having a basically semicircular section hinged along one of its edges to the adjacent part of the edge of the blade and which can be fastened at the other edge to the opposite part of the edge of the flipper blade by appropriate clasping devices.

FIG. 6 illustrates a second embodiment of the flipper according to the invention. According to this embodiment, the flipper shoe comprises a shell 20 which wraps completely round the top of the user's foot and is hinged along one side edge to one side edge of the insole part 2' of the shoe-like part of the flipper, whilst the opposite side edge is constrained in a releasable way to the opposite side edge of the insole part 2' of the shoe by means of adjustable clasps 24, 26. The operation of this embodiment of flipper will be evident from the following description. By releasing the clasps 24, 26, the shell 20 may be raised, thus enabling the foot wearing the boot 4 to slide into/out of the flipper. Once the foot is inserted into the flipper and the studs 6 are plugged into the recesses 8, fastening of the clasps 24, 26 secures the foot to the flipper itself.

Figure 7:
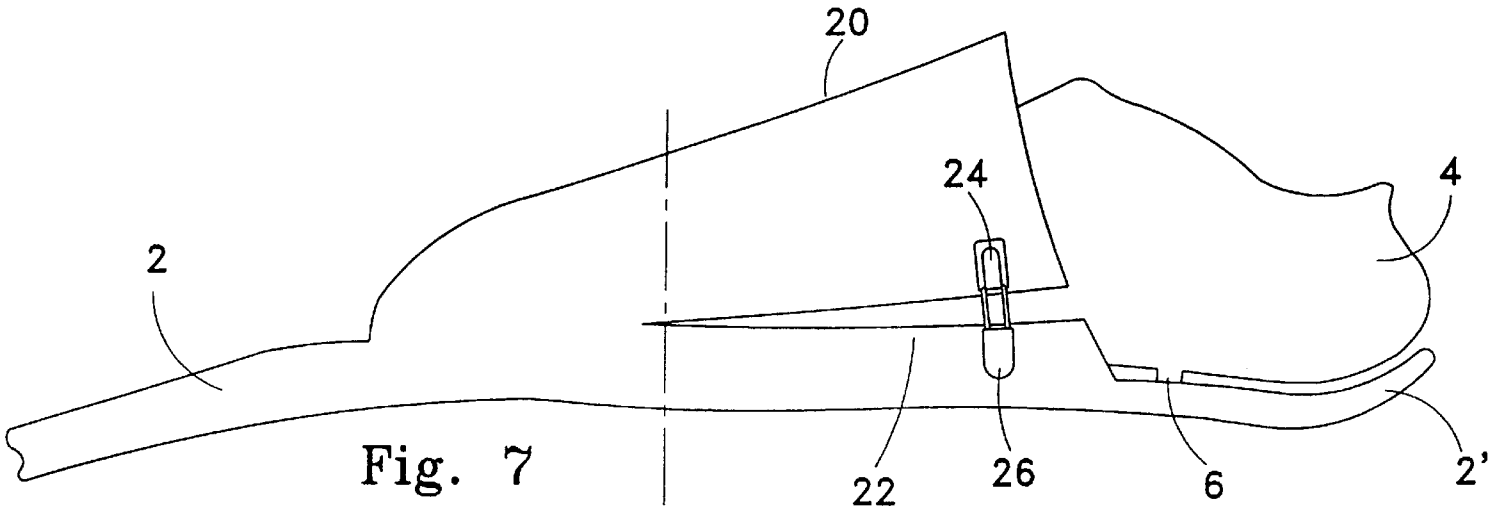
FIGS. 7 and 8 are two side elevations of a flipper according to a fourth embodiment of the present invention, in which the shoe presents a shell having a basically semicircular section, connected along one of its edges to the underlying part of the edge of the flipper blade, whilst its other edge is connected along one of its front side parts to the opposite edge of the flipper blade, whereas the rear part of said edge is separate from the edge of the flipper so that it may be raised elastically (position shown in FIG. 7) to enable the user's foot wearing the boot to slide in. The shoe is then closed, as shown in FIG. 8, by means of an appropriate clasp lever.
Figure 8:
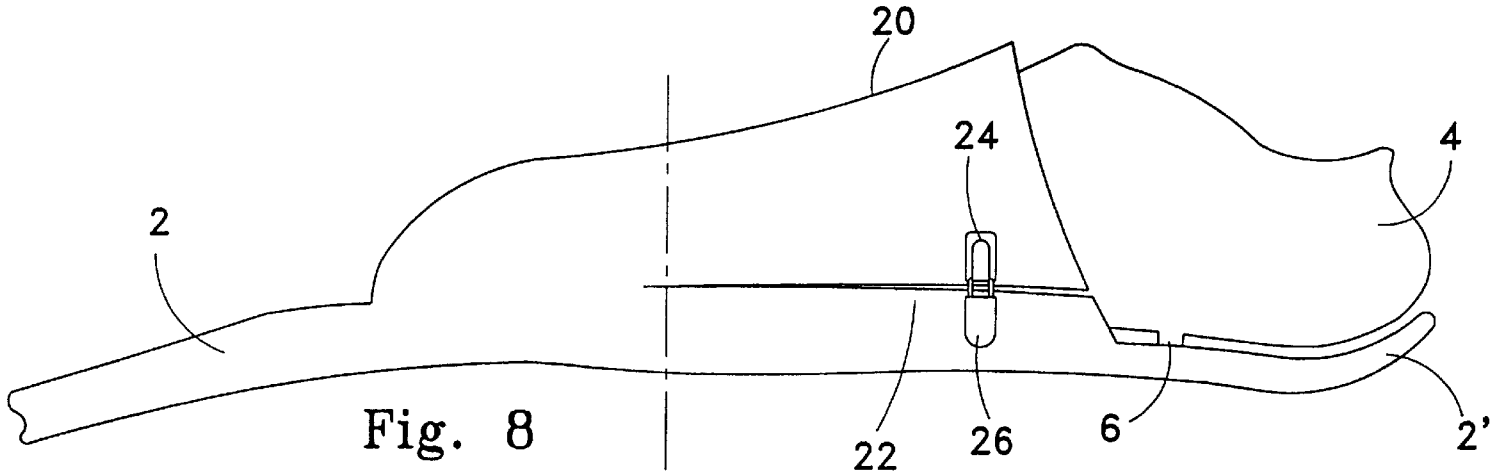

Finally, FIGS. 7 and 8 illustrate a further type of the flipper according to the present invention. According to this variation, the flipper shoe includes a shell 20, which wraps completely round the top and front of the user's foot and which is hinged along one of its side edges to one side edge of the insole part 2' of the shoe-like part of the flipper, in a similar way as was described for the variant of FIG. 6. Its opposite side edge, instead, is constrained in an only partially releasable manner to the rear part of the opposite side edge of the insole part 2' of the shoe by means of adjustable clasps 24, 26. The operation of this embodiment of the flipper will emerge clearly from the following description. By releasing the clasps 24, 26, the rear part of the shell 20 may be raised, thus enabling the foot wearing the boot 4 to slide into/out of the flipper. Once the foot is inserted into the flipper and the studs 6 are plugged into the recesses 8, by fastening the clasps 24, 26 the foot is secured to the flipper itself.

From the foregoing detailed description of the structural and functional characteristics of the swimming flipper that is the subject of the present invention, the advantages already mentioned are further highlighted.

The swimming flipper according to the present invention is able to create a firm constraint between the boot and the blade, and hence between the scuba diver's foot and the blade, with elimination of any undesirable movements as a result of the combined action of the fastening on top, i.e., on the instep of the foot, of the flaps of the parts 10, 12, respectively 20, making up the top constraining part of the flipper shoe, and of the reciprocal slotting of the studs 6, respectively 6', into the complementary recesses 8, 8' respectively, made in the sole of the boot and in the insole part 2' of the flipper, respectively. In addition, the fastening devices 14, 16, 24, 26 that are present on the flaps of the shoe-like part of the flipper enable adjustment of fastening according the shape of the user's foot, thus creating conditions of perfect adherence and utmost comfort for the user during use of the flippers.

Furthermore, the swimming flipper according to the invention allows the use of relatively stiff materials for the shoe-like part 10, 12, 20 of the flipper and the moulding of these parts in a single piece with the insole 2' and the blade 2 of the flipper.

Even though the clasps illustrated are of the two-element type that can be fastened by means of a lever, for example like the ones used for ski boots, it is understood that such clasps may be of any type whatsoever that may be suitable for the purpose.

I claim:

1. A swimming flipper for use with a boot worn on a user's foot, comprising:

a one-piece blade portion and open shoe portion said open shoe portion including an insole portion and a top portion at least partially integrally formed with said insole portion for engaging the boot;

means for releasably securing said top portion over said boot;

said boot including a sole having a plurality of constraining elements;

said insole portion having a plurality of complimentary slot-in constraining elements corresponding with said plurality of constraining elements of said boot, whereby said complimentary constraining elements provide a stable connection between said boot and said shoe portion and, together with said top portion in the engaged position, substantially prevent said boot from moving relative to said shoe portion.

2. The swimming flipper of claim 1, wherein said top portion comprises a flap having a first side attached to a first side edge of said insole portion;

said releasable securing means including at least one clasping device extending between at least one side of said flap and at least one side of said insole portion for securing said flap over said boot.

3. The swimming flipper of claim 1, wherein said top portion comprises at least one pair of flaps each having a lower edge and an upper edge, said lower edges attached to a first and second edge of said insole portion, respectively, and said upper edges of said flaps extending over said boot;

said releasable securing means including at least one clasping device extending between said upper edges of said flaps for securing said flaps in engagement with said boot.

4. The swimming flipper of claim 1, wherein said top portion is a shell substantially covering a front and top portion of said boot, said shell integrally formed with said open shoe portion adjacent a front and first side of said insole portion and having a second, opposite side extending adjacent to a second side of said insole portion;

said releasable securing means including at least one clasping device extending between said second side of said shell and said second side of said insole portion for securing said shell in engagement with said boot.

5. The swimming flipper of claim 1, wherein said plurality of constraining elements are a series of studs which extend transversely across said insole and said plurality of complimentary slot-in constraining elements are a series of transverse recesses extending across said boot.

6. The swimming flipper of claim 1, wherein said plurality of constraining elements are a series of studs which extend longitudinally across said insole and said plurality of complimentary slot-in constraining elements are a series of corresponding longitudinal recesses extending across said boot.

7. The swimming flipper of claim 1, wherein said releasable securing means includes at least one clasping device provided with an adjustable clasp lever for assisting in securing said top portion into engagement with different sizes and shapes of said boots.

8. The swimming flipper of claim 1, wherein said top portion of said open shoe portion is formed from a rigid material relative to the material forming said blade portion of said swimming flipper.

9. A swimming flipper for use with a boot worn on the user's foot, comprising:

one-piece blade portion and shoe portion, said shoe portion including an insole portion for receiving said boot and a top portion for engaging said boot;

at least one clasping device for releasably securing said top portion over said boot;

said boot including a sole having a plurality of constraining elements;

said insole portion having a plurality of complimentary slot-in constraining elements corresponding with said plurality of constraining elements of said boot, whereby said complimentary constraining elements provide a stable connection between said boot and said open shoe portion and, together with said top portion in the engaged position, substantially prevent said boot from moving relative to said shoe portion.

* * * * *